United States Patent [19]

Schuettenberg et al.

[11] Patent Number: 4,729,839

[45] Date of Patent: Mar. 8, 1988

[54] WATER SOLUBLE LUBRICATING ADDITIVES

[75] Inventors: Alexander Schuettenberg; Howard F. Efner; Merlin R. Lindstrom; Rex L. Bobsein; Benedict R. Bonazza; Melvin D. Herd, all of Bartlesville, Okla.

[73] Assignee: Phillips Petroleum Company, Bartlesville, Okla.

[21] Appl. No.: 868,922

[22] Filed: May 29, 1986

[51] Int. Cl.[4] ..... C10M 135/00; C10M 173/00

[52] U.S. Cl. ..... 252/48.6; 252/48.2; 252/49.3; 252/52 A; 524/289; 524/302; 560/112; 560/264

[58] Field of Search ..... 252/48.6, 49.3; 524/302, 289; 560/112, 264

[56] References Cited

U.S. PATENT DOCUMENTS

| | | | |
|---|---|---|---|
| 2,527,374 | 10/1950 | Patrick et al. | 260/77 |
| 2,617,778 | 11/1952 | Glusenkamp | 524/289 |
| 2,743,293 | 4/1956 | De Groote | 260/475 |
| 2,864,866 | 12/1958 | Louthan | 260/607 |
| 3,121,110 | 2/1964 | La Combe | 560/264 |
| 3,159,682 | 12/1964 | Baird et al. | 260/607 |
| 3,236,805 | 2/1968 | Caldo | 260/45.85 |
| 3,314,888 | 4/1967 | Matson | 252/48.6 |
| 3,364,143 | 1/1968 | Johnson | 252/49.5 |
| 3,457,286 | 7/1969 | Dexter et al. | 252/48.6 |
| 3,538,132 | 11/1970 | Distler | 260/399 |
| 4,080,364 | 3/1978 | Kauder et al. | 524/302 |
| 4,250,046 | 2/1981 | Przybylinski | 252/49.3 |
| 4,335,004 | 6/1982 | Efner | 252/48.6 |
| 4,411,808 | 10/1983 | Gutierrez et al. | 252/78.1 |

FOREIGN PATENT DOCUMENTS

| | | | |
|---|---|---|---|
| 664771 | 6/1964 | Italy | 524/302 |

*Primary Examiner*—William R. Dixon, Jr.
*Assistant Examiner*—Ellen McAvoy
*Attorney, Agent, or Firm*—Williams, Phillips & Umphlett

[57] ABSTRACT

A method for preparing a water soluble lubricating additive having the generic structural formula:

$$R_1-\overset{\overset{\displaystyle O}{\|}}{C}-O-R_2-\overset{\overset{\displaystyle O_y}{\|}}{S_x}-(R_3O)_m-(R_4O)_n-H$$

wherein $R_1$ is an alkyl, cycloalkyl, aryl, alkaryl or aralkyl group having from 1 to 34 carbon atoms; $R_2$, $R_3$ and $R_4$ are independent alkylene groups having from 2 to 30 carbon atoms; x is either 1 or 2; y is either 0 or 1 when x=1 and is 0 when x=2; m is either 0 or 1 and n=2 to 30 is disclosed, wherein a sulfur-containing alcohol is initially reacted with an organic carboxylic acid to produce an alkylmercapto ester which is then further reacted with an alkylene oxide to produce the lubricating additive. The water-soluble lubricating additives produced in this manner are useful as lubricating additives for water-based fluids used in metalworking operations.

44 Claims, No Drawings

WATER SOLUBLE LUBRICATING ADDITIVES

This invention relates to compositions used in metalworking operations. In one aspect, this invention relates to compositions which are useful as lubricating additives for water-based fluids used in metalworking operations. In another aspect, this invention relates to compositions which are useful as extreme pressure (EP) lubricating additives for water-based fluids used in metalworking operations.

In metalworking operations, such as cutting, drilling, drawing, tapping, polishing, grinding, turning, milling and the like, it is customary to flood the tool and the work piece with a coolant for the purpose of carrying off heat which is produced during the operations. Such coolants are typically water-based or are based upon liquid organic compounds.

In addition to carrying off heat which is produced during metalworking operations, however, it is also desirable that the fluids used in such operations be capable of reducing friction between the tool and the work piece. Typically, the coolants used in metalworking operations do not possess either lubricity (low load) or extreme pressure (high load) lubricating properties. Therefore, it is customary to employ these coolants in combination with various lubricating additives which do possess such properties.

Although various lubricating additives for water-based metalworking fluids are known in the art, a majority of the commercially available additives are sulfurized and/or chlorinated compounds which are not soluble in water and, therefore, form emulsions when added to a water-based metalworking fluid. Such emulsions can be undesirable in that they often lack the requisite stability, they are more open to attack by bacteria, they leave a residue and they often present disposal problems when spent. Thus, it is desirable to employ either water soluble or water dispersible lubricating additives when working wiht water-based fluids used in metalworking operations.

In addition to lubricating additives, however, many other additives are also used to provide water-based metalworking fluids with various desirable characteristics. Thus, such a water-based fluid will typically contain, among other additives, small amounts of at least one lubricity additive, an extreme pressure additive, a rust controlling additive, a pH buffering additive, a corrosion inhibitor, and a biocide. Therefore, the lubricating additive used in a water-based metalworking fluid are preferably water soluble, and thus suitable for use in a water-based fluid without the presence of an emulsifier, and compatible with other commonly used additives.

It is thus an object of this invention to provide water soluble or water dispersible lubricating additives which, when added to water-based fluids used in metalworking operations, enhance the lubricating characteristics of such fluids and are compatible with other additives commonly used with such fluids.

In accordance with the present invention, a water-soluble lubricating additive having the generic structural formula:

$$R_1-\overset{\overset{\displaystyle O}{\|}}{C}-O-R_2-\overset{\overset{\displaystyle O_y}{\|}}{S_x}-(R_3O)_m-(R_4O)_n-H$$

wherein $R_1$ is an alkyl, cycloalkyl, aryl, alkaryl or aralkyl group having from 1 to 34 (preferably 7 to 21) carbon atoms; $R_2$, $R_3$ and $R_4$ are independent alkylene groups having from 2 to 30 (preferably 2 to 8) carbon atoms; x is either 1 or 2; y is either 0 or 1 when x=1 and is 0 when x=2; m is either 0 or 1 and n=2 to 30 (preferably 12 to 24), is added to water-based fluids used in metalworking operations for the purpose of improving the lubricating characteristics of such fluids.

The term "water soluble" as used herein is intended to refer to additives that are either water soluble or water dispersible.

The lubricating additives of the present invention are prepared by reacting a sulfur-containing alcohol selected from the group consisting of merraptoalcohols, bis(hydroxyalkyl)sulfides and bis(hydroxyalkyl) disulfides with an organic carboxylic acid to produce an alkylmercapto ester. The alkylmercapto ester is then further reacted with an alkylene oxide to produce the lubricating additives of the present invention. In an optional embodiment of the present invention, the lubricating additive thereby produced may be further reacted with an oxidizing agent to produce a sulfoxide.

Other objects and advantages of the invention will be apparent from the foregoing brief description of the invention and the appended claims as well as the detailed description of the invention which follows.

Any suitable sulfur-containing alcohol may be used in the preparation of the lubricating additives of this invention. Suitable sulfur-containing alcohols include alcohols selected from the group consisting of mercaptoalcohols, bis(hydroxyalkyl)sulfides and bis(hydroxyalkyl)disulfides.

Any suitable mercaptoalcohol may be used to prepare the lubricating additives of this invention. An example of a suitable mercaptoalcohol is a mercaptoalcohol having the generic formula:

$$HO-R'-SH$$

wherein R' is an alkylene group having from 2-30 (preferably 2-8) carbon atoms. Examples of suitable mercaptoalcohols are 2-mercaptoethanol, 1-mercapto-2-propanol, 1-mercapto-2-butanol,3-mercapto-1-propanol, 1-mercapto-2-hexanol, 1-mercapto-2-pentanol, 2-mercaptocyclohexanol, 2-mercaptocyclopentanol, 3-mercaptobicyclo[2.2.1]-heptane-2-ol, 1-mercapto-2-phenyl-2-ethanol, 3-mercapto-3-phenyl-propane-1-ol, 2-mercapto-3-phenyl-propane-1-ol, 9-mercapto-10-hydroxyoctadecanoic acid and 10-mercapto-9-hydroxyoctadecanoic acid. A preferred mercaptoalcohol is $HO-CH_2-CH_2-SH$ (2-mercaptoethanol).

When a suitable mercaptoalcohol is used to prepare the lubricating additives of this invention, the lubricating additive produced in accordance with the method of this invention will have the structural formula:

$$R_1-\overset{\overset{\displaystyle O}{\|}}{C}-O-R_2-S-(R_4O)_n-H$$

wherein $R_1$, $R_2$, $R_4$ and n are previously defined.

Any suitable bis(hydroxyalkyl)sulfide or disulfide may be used to prepare the lubricating additives of this invention. An example of a suitable bis(hydroxyalkyl)-sulfide or disulfide is one having the generic formula:

$$HO-R'-S_x-R''-OH$$

wherein R′ and R″ are independent alkylene groups having from 2–20 (preferably 2–5) carbon atoms and x is either 1 or 2. Examples of suitable bis(hydroxyalkyl)sulfides or disulfides are diethanol sulfide, dipropanol sulfide, dibutanol sulfide, dihexanol sulfide, dipentanol sulfide, diethanol disulfide, dipropanol disulfide, dibutanol disulfide, dihexanol disulfide and dipentanol disulfide. Of these, diethanol sulfide and diethanol disulfide are most preferred.

When a suitable bis(hydroxyalkyl)sulfide or disulfide is used to prepare the lubricating additives of this invention, the lubricating additive produced in accordance with the method of this invention will have the structural formula:

$$R_1-\overset{\overset{\displaystyle O}{\|}}{C}-O-R_2-S_x-R_3O-(R_4O)_n-H$$

wherein $R_1$, $R_2$, $R_3$, $R_4$, n and x are as previously defined.

Any suitable organic carboxylic acid may be used to prepare the lubricating additives of the present invention. Suitable ILLEGIBLE carboxylic acid include those acids having at least one $$-\overset{\overset{\displaystyle O}{\|}}{C}-OH$$

group bonded to the carbon atom of an organic radical. Typically the acid will contain from 2 to 35 carbon atoms per molecule. Examples of suitable organic carboxylic acids are 2-ethylhexanoic acid, acetic acid, butyric acid, acrylic acid, capryl acid, perlargonic acid, lanric acid, tall oil fatty acid, myristic acid, palmitic acid, eicosanoic acid, oleic acid, elaidic acid, linoleic acid, linolinic acid, dibenzofurancarboxylic acid, 2-carboxy furan, 2-carboxythiophene, nicotinic acid, cyclohexane carboxylic acid, benzoic acid, naphthalene carboxylic acid, anthracene carboxylic acid, phenylacetic acid, stearic acid, isosebacic acid, adipic acid, lacceroic acid, and other acids of the type listed in U.S. Pat. No. 3,106,570, the disclosure of which is incorporated herein by reference. A preferred organic carboxylic acid is a tall oil fatty acid such as the tall oil fatty acid commercially marketed by Union Camp under the tradename Unitol ACD Special.

Any suitable alkylene oxide may be used in the preparation of the lubricating additives of this invention. Examples of suitable alkylene oxides include ethylene oxide and propylene oxide. Of these, ethylene oxide is preferred.

The sulfur-containing alcohol and organic carboxylic acid may be reacted in any suitable manner and under any suitable conditions to produce the alkylmercapto ester. Although water is a product of the esterification reaction, the reaction conditions are typically designed to remove the water as it is produced in the reaction. Preferably, the reaction is effected in a hydrocarbon solvent which is maintained at reflux temperature and under such conditions that the water is condensed and separated from the refluxing solvent. Suitable solvents are aliphatic and aromatic hydrocarbons having normal boiling points in the temperature range of about 30° C. to about 200° C. Examples of suitable solvents are toluene, the xylencs, any of the isomeric nonanes, decanes, undecanes and mixture thereof.

Although the esterification reaction will proceed in the absence of an added catalyst, it is preferred to have a small concentration of a suitable catalyst present within the reaction. Any suitable catalyst may be used in the esterification process. Examples of suitable catalysts are sulfuric acid, p-toluene sulfonic acid and litanium-containing catalysts such as the type disclosed in U.S. patent application Ser. No. 611,655, which was filed on May 18, 1984. Of these catalysts, tetrabutyl titanate is particularly preferred. The concentration of the catalyst within the esterification reaction will generally be in the range of 0.01 weight-% to about 5.0 weight-% and will more preferably be in the range of 0.5 weight-% to about 2.0 weight-%.

The sulfur-containing alcohol and the organic carboxylic acid may be reacted in any suitable proportions. It is sometimes advantageous to use an excess of either the sulfur-containing alcohol or the organic carboxylic acid to help drive the reaction to the desired product.

The sulfur-containing alcohol and the organic carboxylic acid may be reacted under any suitable reaction conditions. The reaction pressure will generally be atmospheric. The reaction temperature employed will vary over a wide range depending upon the reactants selected, the solvent selected and the desired rate of conversion. Typically, however, the reaction temperature will be in the range of about 30° C. to about 210° C. and will more preferably be in the range of about 90° C. to about 200° C. Similarly, the required reaction time will depend upon the reactants selected, the catalyst employed, the proportional amounts of the reactants and catalyst and the reaction temperature. Typically, however, the reaction time will be in the range of about 10 hours to about 50 hours and will more preferably be in the range of about 12 hours to about 15 hours.

The alklymercapto ester produced by the esterification reaction may be reacted with the alkylene oxide in any suitable manner and under any suitable reaction conditions. Preferably, the alkylmercapto ester is reacted with the alkylene oxide in the presence of a suitable catalyst. Catalysts such as sodium hydroxide, potassium hydroxide and sodium hydride may be used as well as those catalysts disclosed in U.S. Pat. No. 4,223,164 and U.S. Pat. No. 4,239,917. Of these catalysts, sodium hydride is preferred. Any suitable concentration of the catalyst may be used in the etherification reaction. The concentration of the catalyst will typically be in the range of about 0.01 weight-% to about 10 weight-% and will more preferably be in the range of about 2.0 weight-% to about 5.0 weight-%. Optionally, the catalyst and alkylmercapto ester may be pre-reacted for the purpose of eliminating potential foaming difficulties within the reactor.

Any suitable amount of the alkylene oxide may be reacted with the alkylmercapto ester. The water solubility of a lubricating additive produced in accordance with the present invention increases in proportion to the amount of alkylene oxide used in the etherification reaction. Therefore, the amount of alkylene oxide present in the etherification reaction will normally depend upon the degree of water solubility that is desired of the lubricating additive to be produced. Typically, however, the molar ratio of alkylene oxide to alkylmercapto ester will be in the range of about 1:1 to about 30:1 and will more preferably be in the range of about 12:1 to about 24:1. The term "equivalent" is used herein to express the amount of alkylene oxide used in the ILLEGIBLE. An "equivalent" is equal to 100 mole-% of the amount of alkylmercapto ester present in the reaction.

The alkylmercapto ester and alkylene oxide may be reacted under any suitable reaction conditions. The reaction pressure will generally be in the range of about 5.0 psig to about 1000 psig and will more preferably be in the range of about 10 psig to about 80 psig. The reaction temperature employed will vary depending upon the reactants selected, the catalyst selected and the desired rate of conversion. Typically, however, the reaction temperature will be in the range of about 50° C. to about 250° C. and will more preferably be in the range of about 150° C. to about 180° C. Similarly, the required reaction time will depend upon the reactants selected, the catalyst employed, the catalyst concentration and the reaction temperature. Typically, however, the reaction time will be in the range of about 2 hours to about 10 hours and will more preferably be in the range of about 4 hours to about 7 hours.

In an optical embodiment of the present invention, those lubricating additives produced in accordance with the present invention that have the structural formula:

$$R_1-\overset{\overset{\displaystyle O}{\|}}{C}-O-R_2-S-(R_3O)_m-(R_4O)_n-H$$

wherein $R_1$, $R_2$, $R_3$, $R_4$, m and n are as previously defined may be oxidized to produce a sulfoxide. These lubricating additives may be oxidized in any suitable manner. Preferably, the lubricating additive is oxidized by contacting the additive, at a pH of less than seven (7), with an appropriate amount of an oxidizing agent in the presence of a catalytic acid under suitable oxidation conditions. The additive may be neutralized to a pH of less than seven by contacting the additive with the catalytic acid before contacting it with the oxidizing agent.

Any suitable catalytic acid may be used in the oxidation process of this invention. Suitable catalytic acids include mineral acids such as sulfuric acid, hydrochloric acid, phosphoric acid, nitric acid, carbonic acid, hydrofluoric acid, and hydrobromic acid and organic acids such as acetic acid, propionic acid, butyric acid, oxalic acid, benzoic acid and malonic acid. Of these acids, sulfuric acid, hydrochloric acid and acetic acid are preferred. Sulfuric acid is the most preferred catalytic acid because it results in a greater degree of oxidation.

Any suitable amount of said catalytic acid may be used to neutralize the lubricating additive. Typically, the amount of catalytic acid used to neutralize the additive will be determined by what initial pH is desired. Preferably, a sufficient amount of the catalytic acid will be combined with the additive to result in the additive having an initial pH in the range of about 0.15 to about 7.0. Most preferably, the initial pH will be in the range of about 1.0 to about 4.0.

Any suitable oxidizing agent may be used in the oxidation reaction of the present invention. Suitable oxidizing agents include hydrogen peroxide, sodium metaperiodate, peracetic acid, persulfuric acid, perboric acid and perbenzoic acid. Of these oxidizing agents, hydrogen peroxide is preferred.

Any suitable amount of the oxidizing agent may be added to the oxidation reaction of the present invention. Typically, the amount of oxidizing agent added to the reation will be determined by the desired extent of oxidation. Preferably, the amount of the oxidizing agent added to the reaction will be in the range of about 30% to about 150% of stoichiometric.

The oxidation reaction of the present invention may occur under any suitable conditions. The oxidation temperature will generally be in the range of about 10° C. to about 120° C. and will more preferably be in the range of about 40° C. to about 70° C. The oxidation pressure will generally be atmospheric. The length of time needed for the oxidation reaction will generally be that amount of time required for the oxidation reaction to consume the entire amount of the oxidizing agent present in the oxidation reaction. Typically, however, the reaction time will be in the range of about 0.1 hours to about 4.0 hours and will more preferably be in the range of about 0.1 hours to about 1.0 hour.

When an oxidizing agent is used to oxidize the lubricating additives of the present invention, the lubricating additive produced in accordance with the method of this invention will have the structural formula:

$$R_1-\overset{\overset{\displaystyle O}{\|}}{C}-O-R_2-\overset{\overset{\displaystyle O}{\|}}{S}-(R_3O)_m-(R_4O)_n-H$$

wherein $R_1$, $R_2$, $R_3$, $R_4$, m and n are as previously defined.

The lubricating additives of the present invention may be utilized to improved the lubricating properties of any suitable water-based fluid used in metalworking operations.

Any suitable amount of the lubricating additives of this invention may be added to a water-based metalworking fluid. The amount added would generally be sufficient to result in a concentration of the lubricating additive in the water-based metalworking fluid in the range of about 0.01 weight-% to about 10 weight-% based upon the combined weight of the lubricating additive and the water-based fluid. More preferably, the concentration will be in the range of about 0.02 weight-% to about 2.0 weight-% based upon the combined weight of the lubricating additive and the water-based fluid.

In addition to the lubricating additives of the present invention, the water-based metalworking fluid may contain other conventional additives such as additional lubricating additives, rust preventatives, pH modifiers, corrosion inhibitors and biocides. Such conventional additives do not play a part in the present invention, however, and they are well known in the art; therefore, they will not be more fully discussed hereinafter.

The following examples are presented in further illustration of the invention.

EXAMPLE I

This example illustrates the method of preparation which is used to prepare the water-based lubricating additive of the present invention. In this method, 294 g of a tall oil fatty acid (Unitol ACD Special; marketed by Union Camp) were combined with 600 mL of mixed xylenes and 160 g of 2-mercaptoethanol in a 2 liter/-three necked/round bottomed flask which was equipped with a Dean-Stark trap and an argon bubbler. The reaction mixture was brought to reflux for about 10 minutes for the purpose of drying the system via the xylene/water azeotrope. About 2.0 mL of tetrabutyl titanate were then added to the reaction mixture and the reflux was continued for about 14 hours. During this time, the progress of the reaction was monitored by observing the formation of a separate phase within the Dean-Stark trap. At the end of the reflux, the volume of the separate phase, which contained water and 2-mercaptoethanol, was about 56 mL. The reaction product was then placed in a water bath, which was maintained at a temperature of 100° C., and excess xylenes and 2-mercaptoethanol were removed from the reaction product via a rotary evaporator which was maintained at a pressure of 31 mTorr. Analysis of the reaction product showed an ester band existing at 1739 $cm^{-1}$ and a mercaptan sulfur content of about 7.7 weight-%.

About 300 g of the reaction product were then placed in a flask and heated, while being stirred, to a temperature in the range of about 50° C. to about 60° C. About 1.0 g of sodium hydride (80% oil dispersion) was then slowly added to the reaction product. The addition of the sodium hydride was accompanied by a slight foaming of the reaction product. Once the sodium hydride had dissolved, the resulting solution was placed in a 1.0 L stainless steel autoclave and heated to 150° C. under a vacuum. When the temperature of the solution reached 150° C., the vacuum pump was disconnected and 334 g of ethylene oxide were added to the solution over a period of 10 hours. The ethylene oxide was added at a rate which resulted in the autoclave having a pressure of 60 psi while being maintained at a temperature of 150° C. At the end of the reaction, the product was allowed to cool to a temperature of 50° C. before being removed from the autoclave. The reaction product was then filtered to obtain the lubricating additive of this invention. The resulting lubricating additive is a dark colored liquid which is soluble in water.

After filtration, the ethyocylated material may optionally be deodorized by heating the material to a temperature in the range of about 125° C. to about 130° C. while purging the material with argon for about 2 hours.

EXAMPLE IA

This example presents several lubricating additives which were prepared in accordance with the procedure set forth in Example I. Each of these additives is the reaction product of a sulfur-containing alcohol, a tall oil fatty acid and ethylene oxide. The amount of ethylene oxide employed in the reaction is expressed in terms of the number of ethylene oxide "equivalents" that were reacted with the ethylmercapto ester which is produced by the initial reaction of the sulfur-containing alcohol and the tall oil fatty acid. The additives are set forth in Table I.

TABLE I

| Additive | Sulfur-Containing Alcohol | # of $C_2H_4O$ equivalents |
|---|---|---|
| A | diethanol sulfide | 7 |
| B | diethanol disulfide | 7 |
| C | 2-mercaptoethanol | 12 |
| D | 2-mercaptoethanol | 23 |

EXAMPLE II

This example illustrates the use of the lubricating additives of this invention in aqueous solutions. The aqueous solutions were tested in a Falex EP (extreme pressure) test in accordance with ASTM D-3233. Each of the aqueous solutions tested contained about 0.8 weight-% of the indicated additive. The results of these tests are presented in Table II.

TABLE II

| Run | Additive | Fail Load (lbs) |
|---|---|---|
| 1 (Control) | None | 300 |
| 2 (Control) | TOFA and 12 PEO[a] | 1500 |
| 3 (Invention) | Additive C | 4250+ |
| 4 (Control) | TOFA and 23 PEO | 1000 |
| 5 (Invention) | Additive D | 3000 |
| 6 (Invention) | Additive C Sulfoxide[b] | 3750 |

[a]the reaction product of a tall oil fatty acid (TOFA) and the stated number of equivalents of polyethylene oxide (PEO)
[b]Additive C was reacted with hydrogen peroxide to form the corresponding sulfoxide The test data presented in Table II demonstrates that the lubricating additives of this invention are effective extreme pressure lubricating additives in aqueous solutions. The data also shows that Additive C, which is the reaction product of 2-mercaptoethanol, a tall oil fatty acid and 12 ethylene oxide equivalents, is the most effective lubricating additive.

EXAMPLE III

This example illustrates the use of the lubricating additives of this invention in aqueous solutions containing other common additives. The aqueous solutions used in this example had the following composition:

0.08 wt-% triethanolamine, which is used for pH adjustment;

0.6 wt-% polypropylene glycol, which is used as a lubricity agent;

0.5 wt-% or 2.0 wt-% (as indicated) EP lubricating additive; and distilled water.

The aqueous solutions were tested in a Falex EP test in accordance with ASTM D-3233. The results of these tests are presented in Table III.

TABLE III

| Run | EP Additive | Fail Load (lbs) |
|---|---|---|
| 6 (Control) | None | 300 |
| 7 (Invention) | 0.5 wt % Additive A | 3500 |
| 8 (Invention) | 2.0 wt % Additive A | 4000 |
| 9 (Control) | 0.5 wt % Diethanol Disulfide | 3000 |
| 10 (Invention) | 0.5 wt % Additive B | 3500 |
| 11 (Control) | 2.0 wt % Diethanol Disulfide | 2500 |
| 12 (Invention) | 2.0 wt % Additive B | 3250 |
| 13 (Invention) | 0.5 wt % Additive C | 4250+ |
| 14 (Invention) | 2.0 wt % Additive C | 4250+ |
| 15 (Invention) | 0.5 wt % Additive D | 4250 |
| 16 (Invention) | 2.0 wt % Additive D | 4250+ |

The data presented in Table III demonstrates that the lubricating additives of the present invention are effective extreme pressure lubricating additives in aqueous solutions containing various traditional additives. The data also shows that Additive C is again the most effective lubricating additive.

Example IV

This example further illustrates the use of the lubricating additives of this invention in aqueous solutions containing other common additives such as a rust inhibitor, a biocide and an amine which is used for pH adjustment. The aqueous solution used in this example had the following composition:

0.8 wt-% triethanolamine, which is used for pH adjustment;

0.3 wt-% Synkad 500®, a carboxylate rust inhibitor, marketed by Keil Chemical;

.05 wt-% Biopan P-1487(R), a biocide marketed by Keil Chemical;

0.8 wt-% EP lubricating additive; and distilled water.

The aqueous solutions were tested in a Falex EP test in accordance with ASTM D-3233. The results of these tests are presented in Table IV.

TABLE IV

| Run | EP Additive | Fail Load (lbs) |
|---|---|---|
| 17 (Control) | TOFA and 12 PEO | 3000 |
| 18 (Invention) | Additive C | 4000 |
| 19 (Control) | TOFA and 23 PEO | 1500 |
| 20 (Invention) | Additive D | 3250 |

The data presented in Table IV demonstrates that the lubricating additives of the present invention are effective extreme pressure lubricating additives in aqueous solutions containing various traditional additives. The data also shows that Additive C is again the most effective lubricating additive.

EXAMPLE V

This example illustrates the effectiveness of the lubricating additives of this invention after the additives have undergone a deodorizing process. In this example, Additives C and D were subjected to a deodorizing treatment wherein they were heated to a temperature in the range of about 125° C. to about 130°0 C. and then purged with argon for about 2 hours. About 0.8 wt-% of the resulting products were then combined with either distilled water or with the formulated solution described in Example IV to form aqueous solutions. These solutions were then tested in a Falex EP test in accordance with ASTM D-3233. The results of these tests are presented in Table V.

TABLE V

| Run | EP Additive | Fail Load (lbs) |
|---|---|---|
| 21 (Control) | Distilled Water | 300 |
| 22 (Invention) | Distilled Water + Additive C | 4250 |
| 23 (Invention) | Distilled Water + Additive D | 3750 |
| 24 (Invention) | Solution + Additive C | 4250 |
| 25 (Invention) | Solution + Additive D | 4000 |

The data presented in Table V demonstrates that the deodorized lubricating additives of the present invention are also effective extreme pressure lubricating additives in aqueous solutions containing various traditional additives. The data also shows that Additive C is once again the most effective lubricating additive.

While this invention has been described in detail for the purpose of illustration, it is not to be construed as limited thereby but is intended to cover all changes and modifications within the spirit and scope thereof.

That which is claimed is:

1. A method for improving the lubricating properties of a water-based fluid used in metalworking operations comprising the step of adding to said water-based fluid a lubricating additive having the generic structural formula:

$$R_1-\overset{O}{\overset{\|}{C}}-O-R_2-\overset{O_y}{\overset{\|}{S}}_x-(R_3O)_m-(R_4O)_n-H$$

wherein $R_1$ is an alkyl, cycloalkyl, aryl, alkaryl or aralkyl group having from 1 to 34 carbon atoms; $R_2$, $R_3$ and $R_4$ are independent alkylene groups having from 2 to 30 carbon atoms; x is either 1 or 2; y is either 0 or 1 when x=1 and is 0 when x=2; m is either 0 or 1 and n=2 to 30, wherein a sufficient amount of said lubricating additive is added to said water-based fluid to result in a concentration of said lubricating additive in said water-based fluid in the range of about 0.01 weight-% to about 10 weight-% based upon the combined weight of said lubricating additive and said water-based fluid.

2. A method in accordance with claim 1 wherein $R_1$ is an alkyl, cycloalkyl, aryl, alkaryl or aralkyl group having from 7 to 21 carbon atoms; $R_2$ is an alkylene group having 2 carbon atoms; $R_4$ is an alkylene group having 2 carbon atoms; x=1; y=0; m=0 and n=12 to 24.

3. A method in accordance with claim 1 wherein $R_1$ is an alkyl, cycloalkyl, aryl, alkaryl or aralkyl group having from 7 to 21 carbon atoms; $R_2$ is an alkylene group having 2 carbon atoms; $R_4$ is an alkylene group having 2 carbon atoms; x=1; y=1; m=0 and n=12 to 24.

4. A method in accordance with claim 1 wherein $R_1$ is an alkyl, cycloalkyl, aryl, alkaryl or aralkyl group having from 7 to 21 carbon atoms; $R_2$ is an alkylene group having 2 carbon atoms; $R_3$ is an alkylene group having 2 carbon atoms; $R_4$ is an alkylene group having 2 carbon atoms; x=1; y=0; m=1 and n=12 to 24.

5. A method in accordance with claim 1 wherein $R_1$ is an alkyl, cycloalkyl, aryl, alkaryl or aralkyl group having from 7 to 21 carbon atoms; $R_2$ is an alkylene group having 2 carbon atoms; $R_3$ is an alkylene group having 2 carbon atoms; $R_4$ is an alkylene group having 2 carbon atom; x=1; y=1; m=1 and n=12 to 24.

6. A method in accordance with claim 1 wherein $R_1$ is an alkyl, cycloalkyl, aryl, alkaryl or aralkyl group having from 7 to 21 carbon atoms; $R_2$ is an alkylene group having 2 carbon atoms; $R_3$ is an alkylene group having 2 carbon atoms; $R_4$ is an alkylene group having 2 carbon atoms; x=2; y=0; m=1 and n=12 to 24.

7. A method in accordance with claim 1 wherein said concentration is in the range of about 0.02 weight-% to about 2.0 weight-% based upon the combined weight of said lubricating additive and said water-based fluid.

8. A method for producing a lubricating additive comprising the steps of:

reacting a sulfur-containing alcohol selected from the group consisting of mercaptoalcohols, bis(hydroxyalkyl)sulfides and bis(hydroxyalkyl)disulfides with an organic carboxylic acid under suitable esterification conditions to produce an alkylmercapto ester; and, reacting said alkylmercapto ester with an alkylene oxide selected from the group consisting of ethylene oxide and propylene oxide under suitable etherification conditions to produce a lubricating additive having the generic structural formula:

$$R_1-\overset{O}{\overset{\|}{C}}-O-R_2-S_x-(R_3O)_m-(R_4O)_n-H$$

wherein $R_1$ is an alkyl, cycloalkyl, aryl, alkaryl or aralkyl group having from 1 to 34 carbon atoms; $R_2$, $R_3$ and $R_4$ are independent alkylene groups having from 2 to 30 carbon atoms; x is either 1 or 2; m is either 0 or 1 and n=2 to 30.

9. A method in accordance with claim 8 wherein said sulfur-containing alcohol is a mercaptoalcohol.

10. A method in accordance with claim 9 wherein said mercaptoalcohol is 2-mercaptoethanol.

11. A method in accordance with claim 8 wherein said sulfur-containing alcohol is a bis(hydroxyalkyl)sulfide

12. A method in accordance with claim 11 wherein said bis(hydroxyalkyl)sulfide is bis-(2-hydroxyethyl)sulfide.

13. A method in accordance with claim 8 wherein said sulfur-containing alcohol is a bis(hydroxyalkyl)disulfide.

14. A method in accordance with claim 13 wherein said bis(hydroxalkyl) disulfide is bis-(2-hydroxyethyl)-disulfide.

15. A method in accordance with claim 8 wherein said organic carboxylic acid has the formula

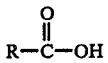

wherein R is an alkyl, cycloalkyl, aryl, alkaryl or aralkyl group containing from 1 to 34 carbon atoms.

16. A method in accordance with claim 15 wherein said organic carboxylic acid is a tall oil fatty acid.

17. A method in accordance with claim 8 wherein said alkylene oxide is ethylene oxide.

18. A method in accordance with claim 8 wherein said alkylene oxide is propylene oxide.

19. A method in accordance with claim 8 wherein said sulfur-containing alcohol and said organic carboxylic acid are reacted in the presence of a catalyst.

20. A method in accordance with claim 19 wherein said catalyst is tetrabutyl titanate.

21. A method in accordance with claim 8 wherein said alkylmercapto ester and said alkylene oxide are reacted in the presence of a catalyst.

22. A method in accordance with claim 21 wherein said catalyst is sodium hydride.

23. A method in accordance with claim 8 wherein said sulfur-containing alcohol and said organic carboxylic acid are reacted at a temperature in the range of about 30° C. to about 210° C., at about atmospheric pressure, for a reaction time in the range of about 10 hours to about 50 hours.

24. A method in accordance with claim 23 wherein said temperature is in the range of about 90° C. to about 200° C. and said reaction time is in the range of about 12 hours to about 15 hours.

25. A method in accordance with claim 8 wherein said alkylmercapto ester and said alkylene oxide are reacted at a temperature in the range of about 50° C. to about 250°C., a pressure in the range of about 5.0 psig to about 1000 psig and for a reaction time in the range of about 2 hours to about 10 hours.

26. A method in accordance with claim 25 wherein said temperature is in the range of about 150° C. to about 180° C. said pressure is in the range of about 10 psig to about 80 psig and said reaction time is in the range of about 4 hours to about 7 hours.

27. A method in accordance with claim 9 further comprising the step of reacting said lubricating additive with an oxidizing agent under suitable oxidizing conditions to produce a corresponding sulfoxide.

28. A method in accordance with claim 27 wherein said oxidizing agent is hydrogen peroxide.

29. A method in accordance with claim 27 wherein said lubricating additive and said oxidizing agent are reacted in the presence of a catalytic acid.

30. A method in accordance with claim 29 wherein said catalytic acid is sulfuric acid.

31. A method in accordance with claim 27 wherein said lubricating additive and said oxidizing agent are reacted at a temperature in the range of about 10° C. to about 120° C., at about atmospheric pressure, for a reaction time in the range of about 0.1 hours to about 4.0 hours.

32. A method in accordance with claim 31 wherein said temperature is in the range of about 40° C. to about 70° C. and said reaction time is in the range of about 0.1 hours to about 1.0 hour.

33. A method in accordance with claim 11 further comprising the step of reacting said lubricating additive with an oxidizing agent under suitable oxidizing conditions to produce a corresponding sulfoxide.

34. A method in accordance with claim 33 wherein said oxidizing agent is hydrogen peroxide.

35. A method in accordance with claim 33 wherein said lubricating additive and said oxidizing agent are reacted in the presence of a catalytic acid.

36. A method in accordance with claim 35 wherein said catalytic acid is sulfuric acid.

37. A method in accordance with claim 33 wherein said lubricating additive and said oxidizing agent are reacted at a temperature in the range of about 10° C. to about 120° C., at about atmospheric pressure, for a reaction time in the range of about 0.1 hours to about 4.0 hours.

38. A method in accordance with claim 37 wherein said temperature is in the range of about 40° C. to about 70° C. and said reaction time is in the range of about 0.1 hours to about 1.0 hour.

39. A lubricating additive comprising a composition having the generic structural formula:

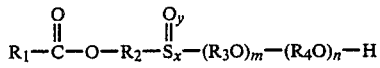

wherein $R_1$ is an alkyl, cycloalkyl, aryl, alkaryl or aralkyl group having from 1 to 34 carbon atoms; $R_2$, $R_3$ and $R_4$ are independent alkylene groups having from 2 to 30 carbon atoms; x is either 1 or 2; y is either 0 or 1 when x=1 and is 0 when x=2; m is either 0 or 1 and n=2 to 30.

40. A composition in accordance with claim 39 wherein $R_1$ is an alkyl, cycloalkyl, aryl, alkaryl or aralkyl group having from 7 to 21 carbon atoms; $R_2$ is an alkylene group having 2 carbon atoms; $R_4$ is an alkylene group having 2 carbon atoms; x=1; y=0; m=0 and n=2 to 30.

41. A composition in accordance with claim 39 wherein $R_1$ is an alkyl, cycloalkyl, aryl, alkaryl or aralkyl group having from 7 to 21 carbon atoms; $R_2$ is an alkylene group having 2 carbon atoms; $R_4$ is an alkylene group having 2 carbon atoms; x=1; y=1; m=0 and n=2 to 30.

42. A composition in accordance with claim 39 wherein $R_1$ is an alkyl, cycloalkyl, aryl, alkaryl or aralkyl group having from 7 to 21 carbon atoms; $R_2$ is an alkylene group having 2 carbon atoms; $R_3$ is an alkylene group having 2 carbon atoms; $R_4$ is an alkylene group having 2 carbon atoms; x=1; y=0; m=1 and n=2 to 30.

43. A composition in accordance with claim 39 wherein $R_1$ is an alkyl, cycloalkyl, aryl, alkaryl or aralkyl group having from 7 to 21 carbon atoms; $R_2$ is an alkylene group having 2 carbon atoms; $R_3$ is an alkylene group having 2 carbon atoms; $R_4$ is an alkylene group having 2 carbon atoms; x=1; y=1; m=1 and n=2 to 30.

44. A composition in accordance with claim 39 wherein $R_1$ is an alkyl, cycloalkyl, aryl, alkaryl or aralkyl group having from 7 to 21 carbon atoms; $R_2$ is an alkylene group having 2 carbon atoms; $R_3$ is an alkylene group having 2 carbon atoms; $R_4$ is an alkylene group having 2 carbon atoms; x=2; y=0; m=1 and n=2 to 30.

* * * * *